United States Patent [19]

South et al.

[11] 4,155,967

[45] May 22, 1979

[54] BUILDING STRUCTURE AND METHOD OF MAKING SAME

[76] Inventors: David B. South, Rte. #3, Box 152; Barry South, Rte. 3, Box 150, both of Idaho Falls, Id. 83401

[21] Appl. No.: 775,097

[22] Filed: Mar. 7, 1977

[51] Int. Cl.[2] ..... E04B 1/32

[52] U.S. Cl. ..... 264/32; 52/80; 52/714; 264/34; 264/45.2; 264/572; 264/46.6; 264/46.7; 264/129; 264/510; 264/512; 264/256; 264/309; 264/314

[58] Field of Search ..... 264/32, 309, 314, 34, 264/45.2, 46.6, 46.7, 89, 94, 129, 256; 52/80, 351, 353, 358, 714

[56] References Cited

U.S. PATENT DOCUMENTS

| | | | |
|---|---|---|---|
| 2,793,887 | 5/1957 | Moore | 52/714 X |
| 3,277,219 | 10/1966 | Turner | 264/45.2 |

*Primary Examiner*—Thomas P. Pavelko
*Attorney, Agent, or Firm*—Fitch, Even & Tabin

[57] ABSTRACT

A building structure and method of making the same are disclosed wherein an inflatable form is inflated and an insulation layer of urethane form is applied to the undersurface of the foam. Hanger members are secured to the foam layer by adhesively affixing planar base portions of the hangers to the foam layer whereafter additional foam is applied to embed the hanger bases. Reinforcing mesh is secured to and supported by the hangers followed by the application of one or more layers of a cementitious material which is allowed to cure. Air pressure beneath the form is progressively increased to maintain a substantially constant uplift force on the foam. The inflatable form may be removed after curing and a protective coating applied to the outer exposed surface of urethane foam to protect it from ultraviolet degradation.

16 Claims, 4 Drawing Figures

BUILDING STRUCTURE AND METHOD OF MAKING SAME

The present invention relates generally to building structures, and more particularly to what is generally termed a monolithic building structure and method for making the same which employs an inflatable form to which is applied, when inflated, interior layers of insulation foam and cementitious material, and which utilizes novel hanger elements facilitating improved attachment to the foam layer and providing substantially improved support strength for the cementitious layers and associated reinforcing mesh as well as providing accurate depth gauging of the cementitious layers.

Building structures made by inflating an inflatable form and applying one or more layers of an insulating foam material interiorly of the inflatable form followed by an interior coating of a cementitious material applied to the foam layer are generally known. In certain applications, such structures provide significant economic advantages over conventional building constructions employing lumber, bricks, concrete blocks and the like and taking conventional rectangular or other square corner structural configurations. The economic advantages of buildings constructed with inflatable forms having insulation foam and concrete layers applied to their inner surfaces derive in part from the relatively short period required to construct such buildings as compared with conventional building techniques. In general, such building structures are made by inflating an inflatable form the peripheral base of which is secured to a footing or foundation, applying a plastic foam layer against the interior surface of the inflated form as by spraying, attaching a metallic reinforcing grid or mesh to the interior surface of the foam layer, and thereafter applying a cementitious layer, again as by spraying, which adheres to the foam layer and is assisted in its support by the reinforcing mesh. See, for example, U.S. Pat. No. 3,277,219, dated Oct. 4, 1966.

In carrying out the known methods of making building structures employing inflatable forms and layers of plastic foam and concrete, the operator applying the foam layer, which is generally applied by spraying, attempts to maintain the foam layer at a generally uniform depth over the entire interior surface of the inflated form. Such uniformity in foam depth is desired to insure a minimum desired foam depth and to achieve a generally uniform interior surface without substantial waste. In the method for making building structures disclosed in the aforenoted U.S. Pat. No. 3,277,219, small gauge blocks of plastic foam are secured against the inflated form so that as the operator sprays the foam layer against the interior surface of the form he can visually observe the depth of foam relative to the gauge blocks. However, in spraying the foam against the inflated form, foam from the spray gun is deposited on the exposed outer ends of the gauge blocks which builds up and adversely affects their use as accurate depth gauges. Additionally, voids are generally formed adjacent the bases of such gauge blocks due to the angle of incidence of the foam from the spray gun, with the result that a uniformly dense foam layer is not achieved.

In another practice employed to establish the depth of the foam layer during spraying of foam against the interior surface of an inflatable form, the operator uses a spoon-like scoop and, after an initial foam application, scoops out a portion of the foam layer to the surface of the inflatable form and visually observes the depth of the foam layer thus far formed. This method has obvious drawbacks due to the time requirement and general inaccuracy of determining layer depth.

Another drawback in the known methods for making monolithic building structures employing inflatable forms with interior layers of insulation foam and cementitious material lies in the manner of supporting reinforcing bars or mesh interiorly of the inflatable form. For example, one technique employs wire clips having barbed forward ends which are forced into the foam layer as by pressure hammering whereafter the reinforcing mesh is secured to the clips through open loops defined at the outer ends of the clips. It has been found that such clips can only support relatively light loads, such as loads of approximately 20 lbs., without being pulled from the foam layers with obvious adverse results.

One of the primary objects of the present invention is to provide an improved building structure and method of making the same wherein an inflatable form is erected and layers of insulation foam and cementitious material are applied interiorly of the form, and wherein novel means are provided for establishing uniform and accurate foam and cementitious layer depth over the interior surface of the inflatable form.

Another object of the present invention is to provide an improved building structure and method of making the same which employs an inflatable form having, when inflated, interior layers of insulating foam and concrete applied thereto, and wherein novel hanger members are employed during construction which are capable of supporting substantially greater loads than have heretofore been possible.

Another object of the present invention is to provide a method of making a building structure wherein an inflatable form is inflated and layers of insulation foam material and cementitious material are applied interiorly of the form, and wherein air pressure is maintained beneath the form and progressively increased as necessary to maintain a substantially constant uplift force on the form.

An important feature of the present invention lies in the use of novel hanger members in building a monolith structure, the hanger members having planar base portions which may be adhesively secured to an initial layer of insulation foam applied against the interior surface of the inflated form, the hanger members having rod elements secured in normal relation to their associated base portions so as to extend outwardly from the foam layer in a manner to provide clear and substantially error free visual observation of the depth of foam and concrete layers being applied, the outer ends of the rods facilitating attachment of a metallic reinforcing mesh thereto during forming of the interior cementitious layer.

Further objects and advantages of the present invention, together with the organization and manner of operation thereof, will become apparent from the following detailed description of the invention when taken in conjunction with the accompanying drawing wherein like reference numerals designate like elements throughout the several views, and wherein.

Figure 1:
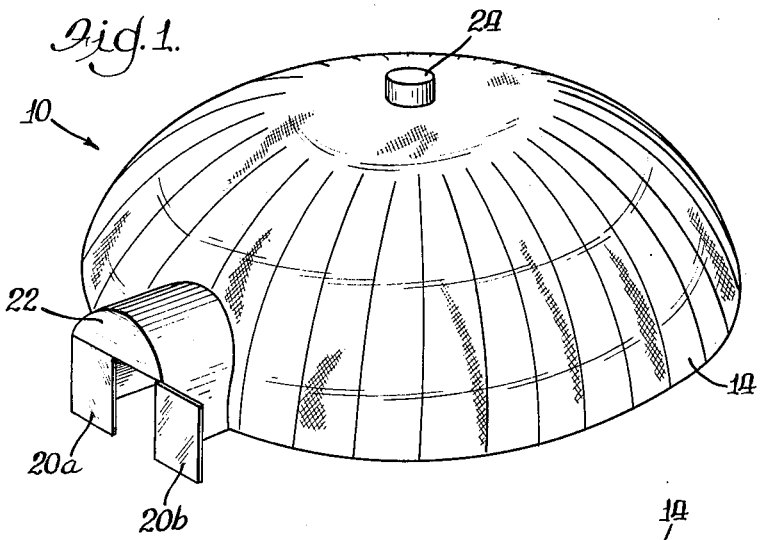
FIG. 1 is a perspective view of a building structure constructed in accordance with the present invention.
Figure 2:
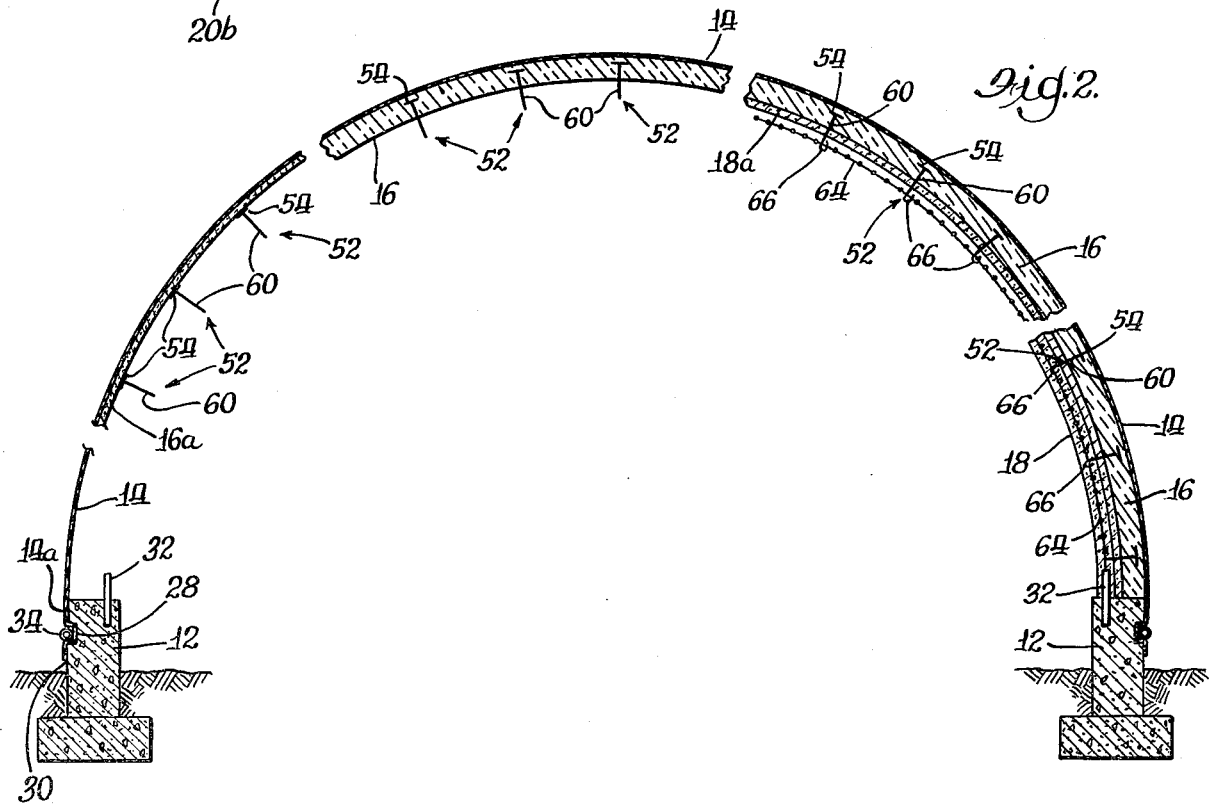
FIG. 2 is a segmented vertical sectional view, on an enlarged scale, through the building structure of FIG. 1 showing the various stages of construction.

Referring now to the drawings, and in particular to FIGS. 1 and 2, a building structure constructed in accordance with the present invention is indicated generally at 10. In the illustrated embodiment, the building structure 10 takes the form of a dome shaped building having a circular base defined by a footing or foundation 12. The footing 12 is made to establish a particular size for the building 10 and is dimensioned to withstand frost conditions and accord with the weight bearing capacity of the underlying soil.

Briefly, the building 10 is constructed by first laying the footing 12 after which an inflatable form 14 is secured at its peripheral bottom edge to the footing in air-tight relation therewith. The form 14 is then inflated and a layer of insulation material 16, such as plastic foam, is applied against the inner surface of the inflated form, followed by the application of a built-up layer of a cementitious material such as concrete as indicated at 18 in FIG. 2. As will become more apparent hereinbelow, the plastic foam layer 16 and concrete layer 18 are preferably applied as built-up layers interiorly of the inflatable form 14 by spraying. The illustrated finished building structure 10 includes access means in the form of a pair of doors 20*a* and 20*b* supported by and within a doorway frame structure 22, it being understood that the access means may take substantially any desired form. In the illustrated embodiment, a centrally located plenum tube 24 is shown projecting upwardly from the apex of the dome shaped building. The plenum tube 24 may extend from ground level up to and through the dome shaped structure and may be used as a source of air during inflation of the inflatable form 14 in the initial stages of construction of the building 10, and thereafter used for ventilation purposes after construction of the building is completed.

The building structure 10 may be formed in situ and constitutes what is generally termed a monolith structure. The building 10, while being illustrated as a dome shaped structure, may take alternative configurations such as a barrel shell shape, an elliptical shape, or a rectangular shape. The method of construction in accordance with the present invention facilitates the construction of buildings of substantial size. For example, the illustrated dome shaped building 10 may have a base diameter as large as approximately 750 feet. A barrel shell configuration may have a width of 600 feet and substantially unlimited length.

The footing or foundation 12 may take the form shown in FIG. 2 and preferably is made of poured concrete. The footing 12 has a circumferentially disposed groove 28 formed in the outer peripheral surface 30. The circumferential groove 28 serves as a keyway facilitating attachment of the peripheral edge of the inflatable form 14. Lengths of steel reinforcing bar or rod 32 are secured in upstanding relation within the foundation 12 so as to be spaced circumferentially about the footing and extend upwardly therefrom. The rods 34 will subsequently project upwardly within the concrete layer 18 and assist in affixing the upper building structure to the foundation 12.

It is desirable that prior to securing the inflatable form 14 to the foundation 12, all equipment that will be used in the construction of the building and which is too large to be moved into the building area through an air-doorway, to be described, be placed within the area of the foundation 12 before the inflatable form 14 is secured in position, the form being placed over the equipment so positioned.

The inflatable form 14 comprises a lightweight gas and liquid impermeable flexible sheet form which may be made of cross laminate plastic, a reinforced plastic coated fabric such as a polyvinylchloride impregnated dacron, or other suitable material. As will become more apparent hereinbelow, the form 14 may be reusable or may be left in place after forming the building 10. The peripheral edge of the form 14, indicated at 14*a*, is secured to the outer peripheral surface 30 of the foundation 12 by a sheathed clamping cable 34 pulled tight to engage the base portion of the inflatable form within the keyway groove 28. If desired, gromets (not shown) may be provided in the peripheral edge of the inflatable form 14 through which the cable 34 is passed prior to tightening the cable and associated form within the keyway groove 28. Alternatively, the cable 34 may comprise a rope sewn into the bottom edge of the form 14. During attachment of the form 14 to the footing 12, the length of reinforcing bar 32 may be bent horizontally inwardly so as not to damage the inflatable form.

Figure 4:
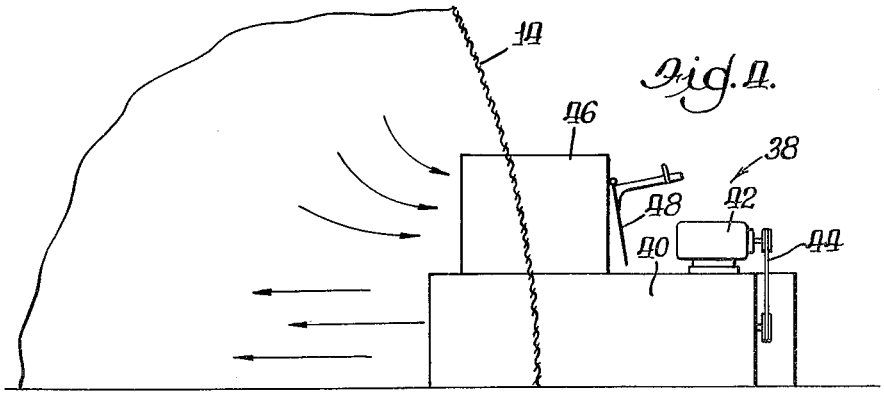
FIG. 4 is a partial vertical sectional view showing a blower assembly associated with the inflatable form in a manner to facilitate inflation of the form.

After securing the form 14 to the footing 12, the form is inflated with air. To this end, a suitable opening is provided in the form 14 adjacent its lower edge of suitable size to position a blower assembly, such as indicated generally at 38 in FIG. 4, which is adapted to introduce air under pressure into the interior of the form 14. The opening in the form 14 in which the blower assembly 38 is positioned may comprise the opening which will ultimately be the entrance and exit area for doors 20*a, b*. The form 14 is relatively lightweight so that an air pressure of approximately ½ inch water static pressure is sufficient to inflate the form. As one example of a blower sufficient to inflate the form 14, the blower assembly 38 includes a primary input air fan housing 40 having a fan drive motor 42, either electrical or gas powered, thereon operative through a drive belt 44 to rotate an internal fan blade (not shown) to effect air input to establish the desired inflation pressure. An exhaust vent housing 46 is mounted on the intake housing 40 and has an adjustable weighted baffle plate or louver 48 of known design hingedly secured thereto and operative to control air exhaust to regulate the air pressure within the inflatable form. It will be understood that alternative blower systems may be readily employed in accordance with the present invention to inflate and maintain the desired pressure within the form 14. Preferably, two fan units are employed with one being a safety back-up system for the other.

After inflating the form 14 by introducing pressurized air beneath the form, a relatively thin layer of insulation material, such as plastic foam, indicated at 16*a* in FIG. 2, is applied to the inner surface of the inflated form by spraying to a thickness of approximately ½ of 1 inch. Before applying the plastic foam layer 16*a*, doorway areas are marked on the inner surface of the inflated form if the area in which the blower assembly 38 is positioned is not to be the final or only door area. The insulation foam layer may comprise a suitable polyurethane or similar type plastic foam suitable for spraying to form the layer 16*a* by conventional techniques. The initial relatively thin foam layer 16*a* provides rigidity for the otherwise pliable form 14.

Figure 3:
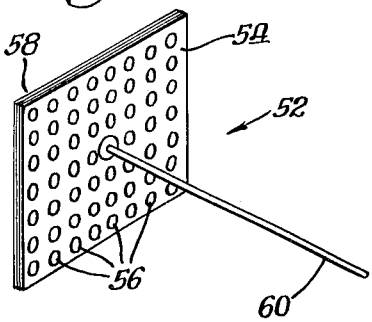
FIG. 3 is a perspective view, on an enlarged scale, of a hanger member in accordance with the present invention.

The initial layer 16*a* of plastic foam sets up relatively quickly and provides a surface against which a plurality of hanger members, each of which is indicated generally at 52, are adhesively secured. In accordance with an important feature of the present invention, and with reference to FIG. 3, each hanger member 52 includes a planar base plate portion 54 which, in the illustrated embodiment, comprises a two inch square plate. The base plate 54 is preferably made of a suitable strength metallic sheet material such as galvanized steel sheet which may have a plurality of holes 56 formed therethrough to reduce the weight of the hanger member. A thin pad 58 is suitably secured to the rear or under surface of the planar base 54 and has an exposed adhesive surface facilitating attachment of the base member 54 to the plastic foam layer 16*a*. Each hanger member 52 has a metallic hanger rod 60, such as aluminum, secured centrally thereto in generally normal relation to the plane of the associated base member 54. The hanger rods 60 have predetermined length, as will become more apparent hereinbelow, and, taken with their associated base portions 54, provide means facilitating visual observation of the depth of insulation foam being applied to the initial layer 16*a* to establish the built-up foam layer 16. The hanger rods 60 also provide means by which a reinforcing mesh is supported adjacent the foam layer 16 as will be described hereinbelow.

The hanger members 52 are adhesively secured to the layer 16*a* of plastic foam such that the hanger rods 60 project inwardly from the foam layer in substantially normal relation thereto. After securing the hanger members 52 to the foam layer 16*a*, additional polyurethane foam is sprayed onto the initially formed layer 16*a* to establish a composite built-up layer 16 of plastic foam having an overall depth of approximately 4 inches. During spray application of the additional urethane foam, the operator is able to visually observe the depth of foam being applied through observing the build up depth along the lengths of the hanger rods 60. The hanger rods 60 are made long enough to extend outwardly from the completed layer of insulation foam 16 a distance of approximately 3 inches.

By employing hanger members 52 in accordance with the present invention, the planar base portion 54 of each hanger member is completely embedded within the foam layer 16 and provides a substantial area over which any load acting on the associated hanger rod 60 is distributed. Additionally, the relatively thin hanger rods 60 result in uniform spraying of the urethane foam about the hanger rods without impairing uniformity of density or layer thickness of the foam. Still further, there is no build up of foam on the outer ends of the hanger rods which would adversely affect the use of the rod as a visual depth measuring gauge. The hanger members 52 are preferably secured to the inner exposed surface of the initial foam layer 16*a* on approximately 3 foot centers over the entire exposed surface of the foam layer 16*a*.

As the urethane foam layer 16 is applied to the inflated form 14, the air pressure created by the blower assembly 38 beneath the form 14 and associated foam layer 16 is simultaneously increased slightly to compensate for the added weight of the foam layer. For example, increasing the air pressure beneath the form 14 and foam layer 16 to approximately 1 inch water static pressure will maintain a substantially constant uplift force on the form, it being understood that the increase in internal gas pressure required to maintain a substantially constant uplift force is dependent on the thickness of the foam layer applied. After completing the build up of the foam layer 16 and adjusting the air pressure within the thus far constructed building structure as necessary to compensate for the additional load on the form 14, reinforcing means in the form of a reinforcing steel wire mesh 64 is secured to the outwardly extending ends of the hanger rods 60 by suitably bending or looping the ends of the hanger rods over the reinforcing mesh such as indicated by bent or formed loops 66 in FIG. 2. The reinforcing mesh 64 is of known design and is preferably applied so as to cover substantially the full interior surface of the thus far constructed building, it being understood that the foam layer 16 and associated reinforcing mesh are not positioned interiorly of the intended openings for doors and windows in the completed building structure. The reinforcing mesh 64 is preferably positioned approximately 1 inch from the inner exposed surface of the foam layer 16. The size and amount of the reinforcing mesh 64 may vary depending on the engineering requirements of the building being constructed.

Simultaneously with securing the reinforcing mesh 64 to the hanger members 52, metal strap hangers (not shown) may be secured to the reinforcing mesh for later suspension or mounting of lights, wiring fixtures and the like. Preconstructed steel trusses are also placed at the previously marked door and window openings on the form 14 for reinforcing around the openings to be made in the sheel structure, the trusses being permanently secured in place by subsequent spraying of the cementitious layers 18 in completing the building structure.

Prior to securing the reinforcing mesh 64 to the hanger members 52, a coating of cementitious material such as a suitable concrete mix may be applied against the inner surface of the foam layer 16 to a thickness of approximately ½ inch, as indicated at 18*a* in FIG. 2. If such preliminary coating 18*a* of concrete is desired, the reinforcing mesh 64 is secured to the hanger members after forming such initial layer of concrete. Assuming an initial layer 18*a* of concrete to have been applied to the insulation foam layer 16, the reinforcing mesh 64 is positioned to approximately within one inch of the initial layer of concrete. Thereafter, a second layer of concrete is applied to the inner exposed surface of the first layer 18*a* to a depth of approximately ¾ inch.

The built-up cementitious layer 18 may comprise a sprayable cementitious material such as commercially available as "Gunite" and "Shotcrete" which are mixtures of graded sand and cement. The cementitious layers may be applied through a hose at high velocity which results in extremely dense concrete having a cured compressive strength of approximately 8,000–10,000 p.s.i. While uncured, the concrete layers can be shaped with suitable scrapers. The cementitious material may contain metallic reinforcing fibers which facilitate spraying.

A third coating of cementitious material is applied to the previously applied coatings or layers to bring the final thickness of the built-up composite concrete layer 18 to a depth of approximately 2 inches. In this manner, the reinforcing mesh 64 will be positioned internally of the layer of concrete 18 to provide optimum reinforcing strength. It can be seen from FIG. 2 that as the concrete layer 18 is built-up adjacent the footing 12, it will also cover the upstanding reinforcing bars 32 to assist in affixing the upper wall structure to the footing.

As the cementitious layer 18 is built-up by successive layers, the air pressure from the blower assembly 38 is gradually increased to, for example, approximately 3–4 inches water static pressure depending upon the thickness and density of cementitious material layer selected, to compensate for the added weight of the concrete layer and maintain a substantially constant uplift force on the form 14. It may not be necessary to increase the air pressure internally of the shell structure after the first two layers of concrete are applied due to the fact that the built-up concrete layer reaches a point at which it can carry its own weight. It is seen that a relatively small differential pressure is sufficient to maintain a substantially constant uplift force on the form 14 during construction of the building structure 10.

Each successive layer of concrete is applied before the previous layer is allowed to cure completely so as to effect maximum bonding between the successive layers of concrete. After the concrete layers are allowed to cure, the air pressure may be turned off. The door trusses and any desired window trusses formed in place by the sprayed concrete may then be prepared to receive associated doors and windows in a known manner.

After completing the building structure 10 thus far described, the inflatable form 14 may be removed from the foam layer 16 and underlying concrete layer 18 and a protective coating such as asphalt and/or a suitable paint can be applied over the exposed urethane foam layer to protect it from moisture and ultraviolet degradation caused by exposure to the sun. The inflatable form 14 may then be reused. Alternatively, the inflatable form 14 may be retained on the completed building structure and, if desired, coated to provide additional protection to the building structure. A further alternative is to remove the form 14, apply a 2 inch thick coat of shotcrete to the lower outer exposed portion of the foam layer 16 followed by a moisture barrier coating of asphalt over the entire structure and a final coating of paint for obtaining the desired appearance.

In accordance with the method of constructing the building structure 10 in accordance with the present invention, a number of benefits are provided over conventional building techniques. The thin shell concrete structure is protected from thermal shock by the foam layer 16. Without such protection, the stress within the concrete layer would be greatly multiplied and thus require a thicker concrete layer with significantly increased reinforcement. In accordance with the method of the present invention, the hanger members 52 with their associated protruding hanger rods 60 provide means for easily and accurately gauging the thickness of the insulation foam layer during build up, and gauging the thickness of the initial layers of concrete as they are spray applied. This substantially lessens the possibility of inadequate placement of the foam and concrete material with resulting uneven layer formation. Additionally, by completely embedding the plate portions 54 of the hanger member 52, substantially greater loads may be supported by the hanger members than have heretofore been possible with the prior art techniques.

While a preferred building structure and method of making the same in accordance with the present invention have been illustrated and described, it will be understood to those skilled in the art that changes and modifications may be made therein without departing from the invention in its broader aspects. Various features of the invention are called for in the following claims.

What is claimed is:

1. A method of constructing a building structure comprising the steps of securing an inflatable form at its peripheral edge to a base, inflating said form by introducing a gas under pressure beneath said form so as to define an interior chamber, applying a first layer of insulation foam material of a substantially predetermined depth of the inner surface of said inflated form, securing a plurality of hanger members to the inner surface of said first foam layer, each of said hanger member including a base portion disposed against said first foam layer and having a hanger rod of predetermined length projecting from said base portion toward said interior chamber, said base portions each having greater exposed surface area than the transverse cross-sectional area of the corresponding hanger rod, applying a second layer of insulation foam material of a substantially predetermined depth to the inner exposed surface of said first foam layer so as to embed said base portions of said hanger members within said foam material, the depth of said second foam layer being established by observing the build up of foam material along the predetermined lengths of said hanger rods, said hanger rods being of sufficient length to have exposed end portions after applying said second layer of foam material, securing reinforcing mesh to said exposed end portions of said hanger rods in supported relation therewith, applying one or more layers of a cementitious material to the inner exposed surface of said second foam layer so that said reinforcing mesh is embedded within said cementitious layer, and allowing curing of said applied layers.

2. The method as defined in claim 1 wherein said inflatable form is adapted to be inflated by air at a pressure of approximately one-half inch water static pressure.

3. The method of claim 1 wherein said layers of insulation and cementitious material are applied by spraying.

4. The method as defined in claim 1 wherein said base portions of said hanger members have adhesive surfaces thereon, and wherein said step of securing said hanger members to said first foam layer comprises adhesively affixing said base portions to said first foam layer.

5. The method as defined in claim 1 including the additional steps of removing said inflatable form after said cementitious layers have cured, and coating the outer exposed surface of said first foam layer so as to protect it from moisture and ultraviolet degradation.

6. The method of claim 1 wherein a first relatively thin layer of cementitious material is applied to said second foam layer prior to securing said reinforcing mesh to said exposed hanger rods.

7. The method as defined in claim 1 wherein said base portions of said hanger members are generally planar.

8. The method as defined in claim 1 including the preliminary step of forming said base to which the peripheral free edge of said inflatable form is secured, said form having means disposed adjacent its said peripheral edge facilitating attachment of said free edge to said base.

9. The method as defined in claim 8 wherein said base has a circumferentially disposed keyway, and wherein said free edge of said form includes a pull cable facilitating attachment of said free edge of said form to said base.

10. The method of claim 1 wherein said first layer of insulation foam material comprises polyurethane foam applied at a thickness of approximately one-half inch.

11. The method of claim 10 wherein second layer of foam is applied to establish a composite built-up layer of foam of approximately 4 inches.

12. The method of claim 11 wherein said cementitious layers are applied to establish a final cementitious composite layer thickness of approximately 2 inches.

13. The method of claim 1 including the steps of gradually increasing the air pressure beneath said foam sufficiently to maintain a substantially constant uplift force on said form as said cementitious layers are applied.

14. The method as defined in claim 13 wherein said cementitious layer is applied by spraying a plurality of cementitious coatings onto said foam layer to progressively build up a cementitious layer of predetermined thickness.

15. The method of claim 14 wherein said step of attaching said reinforcing mesh to said hanger rods is effected prior to applying said cementitious layer.

16. The method of claim 14 wherein each successive cementitious coating is applied before the previous coating of cementitious material is completely cured.

* * * * *

UNITED STATES PATENT AND TRADEMARK OFFICE

CERTIFICATE OF CORRECTION

PATENT NO. : 4,155,967

DATED : May 22, 1979

INVENTOR(S) : David B. South, Barry South

It is certified that error appears in the above-identified patent and that said Letters Patent are hereby corrected as shown below:

In the Abstract:

Line 3, "form" should be --foam--.

Line 4, "foam" should be --form--.

In the Patent:

Column 4, line 59, "of" (second occurrence) should be --to--.

Column 6, line 31, "sheel" should be --shell--.

Column 6, line 33, "layers" should be --layer--.

Column 8, line 10, "of" (first occurrence) should be --to--.

Column 8, line 13, "member" should be --members--.

Column 9, line 5, "The method of Claim 10" should read

--The method as defined in Claim 10--.

Signed and Sealed this

*Eighteenth* Day of *December 1979*

[SEAL]

*Attest:*

SIDNEY A. DIAMOND

*Attesting Officer*

*Commissioner of Patents and Trademarks*